US005975578A

United States Patent [19]

Mayer

[11] Patent Number: 5,975,578

[45] Date of Patent: Nov. 2, 1999

[54] PORTFOLIO AND METHOD OF MAKING THE SAME

[75] Inventor: Lawrence Mayer, Tenafly, N.J.

[73] Assignee: Graphic Vinyl Products, Inc., Newark, N.J.

[21] Appl. No.: 09/098,053

[22] Filed: Jun. 16, 1998

[51] Int. Cl.[6] ..... B42D 3/00

[52] U.S. Cl. ..... 281/37; 281/29; 281/36; 412/902

[58] Field of Search ..... 281/15.1, 21.1, 281/28, 29, 36, 37, 51; 412/1, 4, 902

[56] References Cited

U.S. PATENT DOCUMENTS

| | | | |
|---|---|---|---|
| D. 263,095 | 2/1982 | Wajs et al. | D3/52 |
| D. 299,932 | 2/1989 | Beleckis | D19/26 |
| D. 302,699 | 8/1989 | Popat et al. | D19/26 |
| D. 302,830 | 8/1989 | Popat et al. | D19/26 |
| D. 314,587 | 2/1991 | Young | 281/31 |
| D. 335,685 | 5/1993 | Chen | D19/26 |
| D. 343,862 | 2/1994 | Wyant | D19/26 |
| 4,832,372 | 5/1989 | Young | D19/26 |
| 4,991,767 | 2/1991 | Wyant | 229/1.5 R |
| 5,219,437 | 6/1993 | Moor et al. | 281/37 X |
| 5,704,646 | 1/1998 | Tzeng | 281/37 X |
| 5,762,375 | 6/1998 | Kogutt et al. | 281/37 |

*Primary Examiner*—Willmon Fridie, Jr.
*Attorney, Agent, or Firm*—Frishauf, Holtz, Goodman, Langer & Chick, P.C.

[57] ABSTRACT

A portfolio includes a rectangular piece of a canvas material having an outer peripheral edge, a rectangular peripheral piece of a vinyl material having an inner peripheral edge that slightly overlaps the outer peripheral edge of the canvas material, with an inner surface of the inner peripheral edge and an outer surface of the outer peripheral edge being heat sealed to each other with a predetermined stitching pattern, a first cardboard rigidifying member positioned to an inner surface of the canvas material corresponding to a top panel of the desk folder, a second cardboard rigidifying member positioned to an inner surface of the canvas material adjacent to the first rigidifying member, corresponding to a bottom panel of the desk folder, with a spacing between the first and second rigidifying members which defines a narrow binding edge which connects together side edges of the top and bottom panels, a vinyl backing member positioned over the first and second rigidifying members being heat sealed to the vinyl material so as to retain the rigidifying members between the backing member and the canvas material, and decorative stitching applied to an outer periphery of the portfolio.

24 Claims, 4 Drawing Sheets

PORTFOLIO AND METHOD OF MAKING THE SAME

FILED OF THE INVENTION

The present invention relates generally to portfolios, binders, book covers and the like for carrying notes and writing pads, and is more particularly directed to a portfolio which is designed to be more efficiently and economically produced than conventional portfolios.

BACKGROUND OF THE INVENTION

Portfolios are conventionally constructed with first and second panels connected together at a common side edge and from a combination of materials in order to provide an enhanced appearance to the finished product. For example, it is known to produce a portfolio from a single duck cloth (or nylon) sheet (for an outer covering) and a complementary single vinyl sheet (for an inner covering). Portfolios also include a decorative vinyl-like or leather material sewn to the outer periphery of the duck cloth sheet and the complementary vinyl sheet to connect the two sheets of material and to enhance the appearance of the portfolio. Cardboard or other stiffening material is interposed between the inner surfaces of the duck cloth and vinyl sheets to provide rigidity to the portfolio.

As stated above, with such known portfolios, the outer decorative vinyl material is secured to the duck cloth and vinyl sheets by stitching. This is a very labor intensive operation which substantially adds to the time required to manufacture each portfolio and therefore increases the cost of production.

OBJECTS AND SUMMARY OF THE INVENTION

Accordingly, it is an object of the invention to provide a portfolio, ring binder, business card file, compact disc case, photo album or book cover which is more easily and economically manufactured then conventional items.

It is another object of the invention to provide a portfolio that does not require stitching to secure the parts together.

It is still another object of the invention to provide a portfolio in which parts of the portfolio are secured by heat sealing while still providing the appearance of stitching.

It is yet another object of the invention to provide a portfolio in which there is a more efficient use of material.

In accordance with one form of the present invention, a portfolio includes a cover sheet having outer peripheral edge, an outer surface and an inner surface, a backing sheet having an outer peripheral edge, an outer surface and an inner surface, and a stiffening member interposed between the inner surface of the cover sheet and the inner surface of the backing sheet. The portfolio also includes an edge member having an outer peripheral edge, an inner peripheral edge, an outer surface and an inner surface. The inner peripheral edge of the edge member overlaps the outer peripheral edge of the cover sheet, and the inner surface of the edge member and the outer surface of the cover sheet are heat sealed together. In addition, the outer peripheral edge of the edge member and the outer peripheral edge of the backing sheet are heat sealed together to retain the stiffening member between the cover sheet and the backing sheet.

In accordance with another form of the present invention, a method of forming a portfolio includes providing a cover sheet including an outer peripheral edge having a perimeter, an outer surface and an inner surface, and overlying an edge member including an outer peripheral edge having a perimeter greater than the perimeter of the outer peripheral edge of the cover sheet. The method also includes heat sealing the edge member to the cover sheet proximate the outer peripheral edge of the cover sheet, and positioning a first stiffening member to an inner surface of the cover sheet corresponding to a top panel of the portfolio. A second stiffening member is positioned to an inner surface of the cover sheet adjacent the first stiffening member corresponding to a bottom panel of the portfolio, with a spacing between the first and second stiffening members which defines a narrow binding edge which connects together side edges of the top and bottom panels. The method also includes positioning a backing sheet over the first and second stiffening members and heat sealing the backing sheet to the edge member so as to retain the stiffening members between the backing sheet and the cover sheet.

The above and other objects, features and advantages of the invention will become readily apparent from the following detailed description thereof, which is to be read in connection with the accompanying drawings.

DETAILED DESCRIPTION OF THE PREFERRED EMBODIMENT

Figure 1:
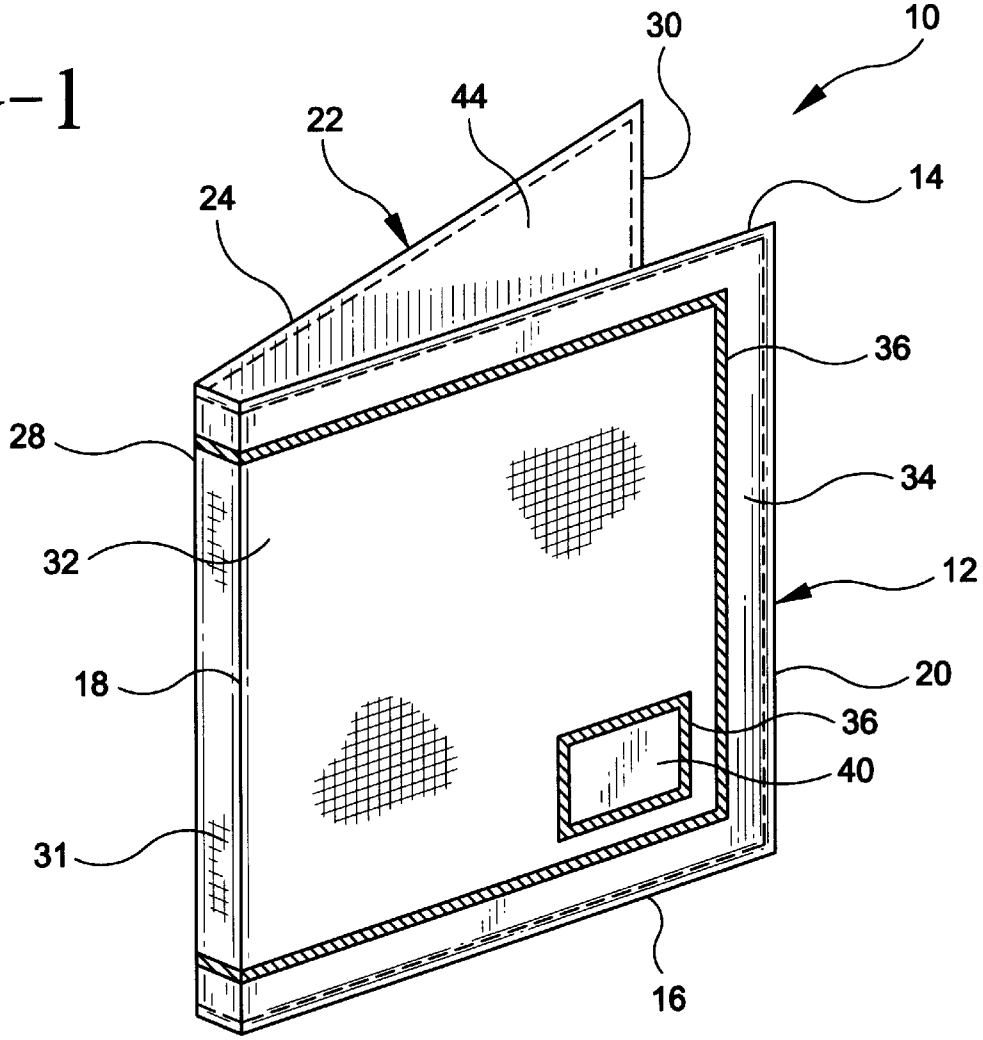
FIG. 1 is a perspective view of a portfolio according to the present invention in a partially closed configuration.
Figure 2:
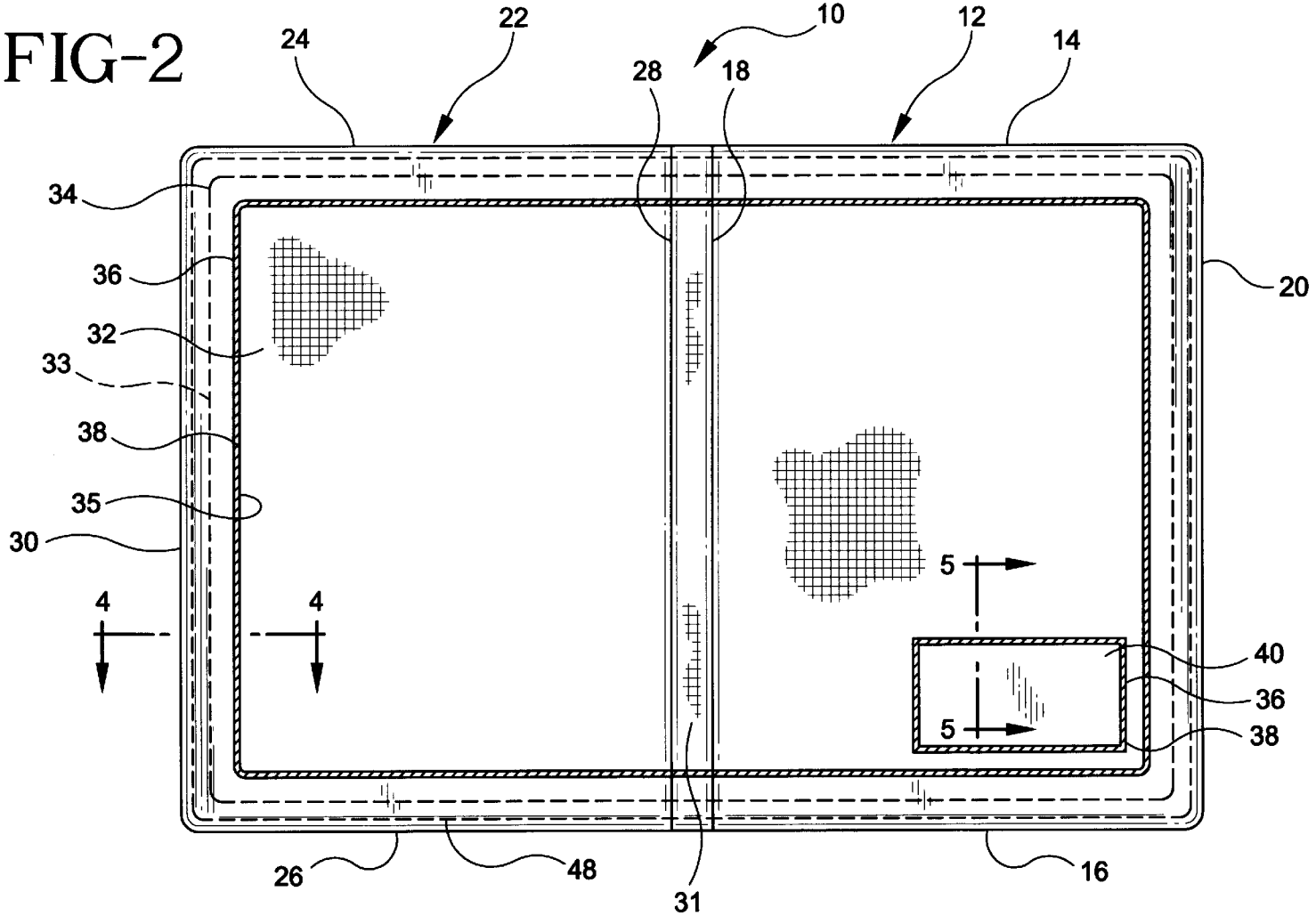
FIG. 2 is a plan view of a portfolio in an open configuration showing front and back outer covers of the portfolio.

Referring now to the drawings in detail, and initially to FIGS. 1 and 2, a portfolio 10 according to the present invention preferably includes a substantially rectangular top panel 12 having an upper edge 14, a lower edge 16, a left side edge 18 and a right side edge 20. A substantially rectangular bottom panel 22 is also provided, having an upper edge 24, a lower edge 26, a left side edge 28 and a right side edge 30. Preferably, the top panel 12 and bottom panel 22 are the same size. A narrow rectangular binding edge 31 is utilized to couple side edges 18 and 28 of respective top and bottom panels 12 and 22.

Specifically, a rectangular piece of nylon cloth laminated to a PVC film (cover sheet) or other similarly durable material 32 (such as cotton or polyester laminated to a PVC film) is used as an outer covering material. Nylon cloth material 32 preferably has an outer edge 33 (i.e., perimeter of the rectangular piece) which is slightly smaller (that is, in height and width) than the rectangular dimensions (that is, outer edge) of portfolio 10 in the open configuration of FIG. 2. An outer decorative material 34 (edge member) which extends only about a small margin at the periphery of desk folder 10 is provided so that an inner edge 35 of outer decorative material 34 at least slightly overlaps the outer edge 33 of nylon cloth material 32. Outer decorative material 34 can be any suitable material, such as an expanded vinyl and the like, which is capable of at least partially melting during a heat sealing process (using a heat sealing electrode or heat sealing die). The outer decorative material 34 is initially in the form of a sheet and is provided in overlying relation to the entire nylon cloth material 32, as well as extending to greater outer dimensions.

Outer decorative material 34 is fixed to nylon cloth material 32 by a heat sealing process using a heat sealing die (not shown) that is applied to outer decorative material 34. Specifically, the heating sealing die melts at least a portion of outer decorative material 34 so that the outer decorative material is forced through the nylon cloth (i.e., to bleed through) to contact the vinyl backing of the cloth so that the outer decorative material 34 bonds to the nylon cloth material 32.

As a result, a heat sealed channel 36 is formed in outer decorative material 34. It is preferred that the heat seal die be a known applique heat sealing die, which heat seals and also provides a design in the form of heat sealed channel 36. Preferably, the design produces oval raised portions 38, as shown in FIGS. 4–6, that when viewed from a suitable distance, simulate stitching.

Simultaneous to the heat sealing process, a knife rule (not shown) runs alongside the heat seal die to separate and enable removal of an inner area of the vinyl outer decorative material 34 within (that is, bounded by) the heat sealed channel 36 so that the nylon cloth material 32 is exposed in an interior portion of the portfolio and is bounded by the outer decorative material 34.

The portfolio 10 also includes a vinyl patch 40 (capable of having an identifying printing applied thereon) applique heat sealed about its outer edges by the (same or similar) heat seal die to the nylon cloth material 32 at a position constituting the top front face of top panel 12. The applique heat sealing of patch 40 also forms a channel 36 with oval raised portions 38 shown in FIG. 6. In the preferred embodiment, the nylon cloth material 32 (at least a portion thereof) beneath patch 40 bounded by the heat sealed channel 36 is removed so that the texture of the sheet of nylon cloth material 32 beneath patch 40 does not affect the clarity of the identifying printing which may be applied to patch 40. It is also foreseen that the patch could be heat sealed to the nylon cloth material prior to removal of the inner area of the vinyl outer decorative material by the knife rule as explained above. In such a situation, the knife rule would also have to sever the vinyl outer decorative material from the portion thereof which forms the patch 40.

Figure 3:
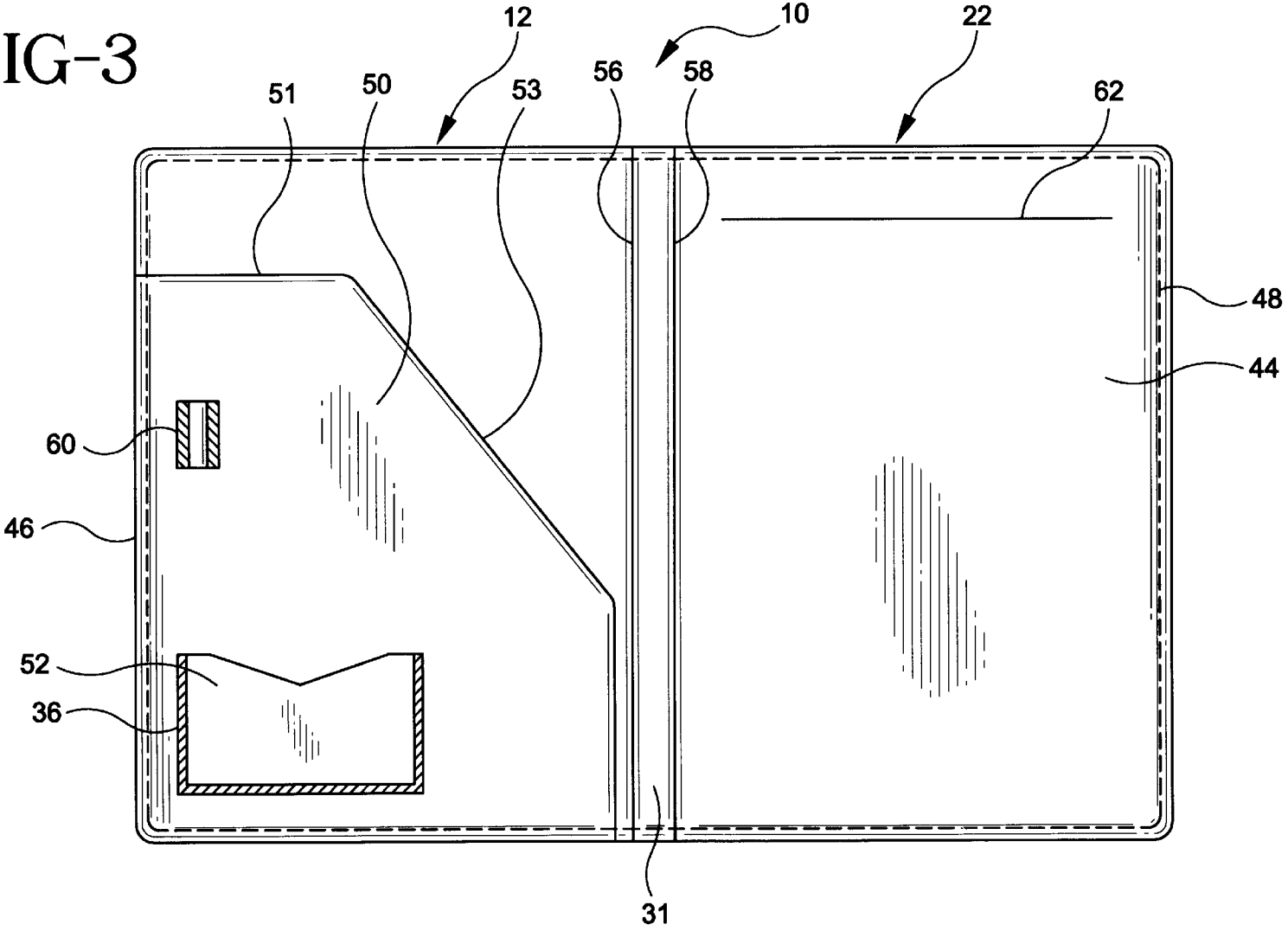
FIG. 3 is a plan view of the portfolio in the open configuration showing front and back inner covers of the portfolio.
Figure 5:
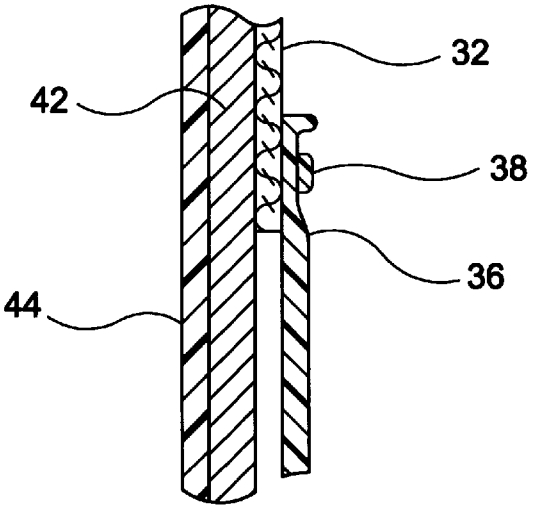
FIG. 5 is a cross-sectional view of the portfolio of FIG. 2, taken along line 5—5 thereof.
Figure 6:
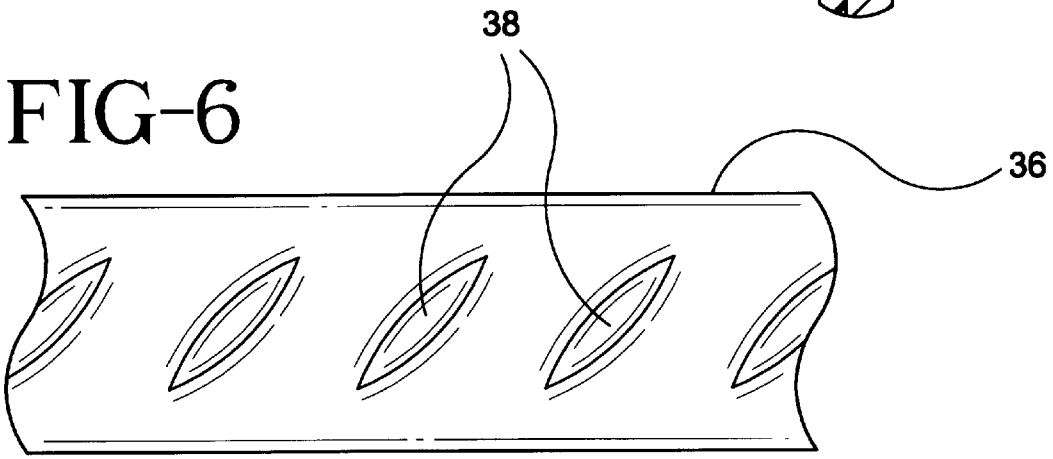
FIG. 6 is an enlarged top plan view of a heat seal channel formed during a heat seal process.
Figure 4:
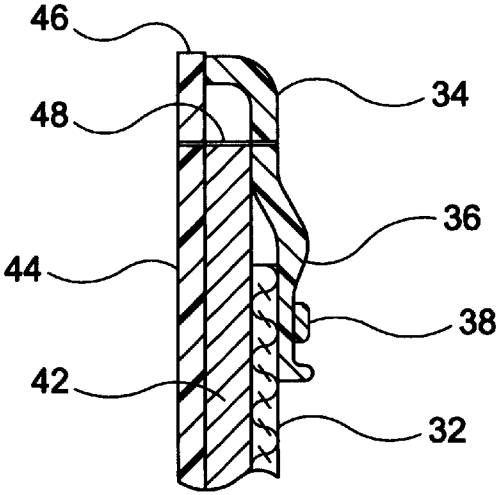
FIG. 4 is a cross-sectional view of the portfolio of FIG. 2, taken along line 4—4 thereof.

Thereafter, in order to impart rigidity to the top and bottom panels 12, 22 of portfolio 10, rectangular cardboard pieces 42 (stiffening members), each having a dimension similar to respective top panel 12 and bottom panel 14, are respectively positioned proximate the inner surface of canvas material 32 (see FIGS. 4 and 5). As shown in FIG. 3, an inner vinyl backing 44 (backing sheet) is then positioned over the entire inner surface of desk folder 10 (and the cardboard pieces 42), and the outer peripheral edges of outer decorative material 34 and vinyl backing 44 are preferably heat sealed along an edge 46 of the portfolio 10. Further, vinyl backing 44 is heat sealed to canvas material 32 along central fold lines 56 and 58, thereby more completely securing cardboard pieces 42 in place.

An outer decorative stitching 48 is then provided (for ornamental purposes and durability). The decorative stitching preferably traverses through outer decorative material 34, cardboard pieces 42 and vinyl backing 44, as shown in FIGS. 1–4. However, it is foreseen that the stitching 48 need not traverse through cardboard pieces 42.

Further, as shown in FIG. 3, the inner area of the sheet of vinyl decorative material 34 that was cut away by the knife rule can be formed (cut) into a desired shape to form a flap 50. The flap 50 is secured to vinyl backing 44 by heat sealing (or the like) at the left and bottom edges thereof along edge 46 of portfolio 10 as shown in FIG. 3. The flap 50 is preferably open at the upper side 51 and right side 53 for receiving papers therein. As a result of forming flap 50 from the inner area of the vinyl decorative material 34, there is little waste of material (that is, the inner area of the vinyl decorative material 34 is utilized). In addition, since the same portion of vinyl material used to form outer decorative material 34 is also used to form inner flap 50, color, texture and other physical characteristics of the materials remain consistent for each portfolio 10.

Still further, a card holder 52, penholder 60 or calculator holder (not shown) and the like can be heat sealed along a U-shaped channel 36 (card holder) or only parallel channels (pen holder) to inner flap 50 as shown in FIG. 3. In the preferred embodiment, card holder 52 and pen holder 60 are formed utilizing the inner area of the vinyl decorative material 34 that was cut away by the knife rule to expose the nylon cloth material 32.

It is also foreseen that the inner vinyl backing 44 may include a slit 62 therethrough enabling the cardboard backing of a note pad (not shown) to be inserted therein for being securely held by the portfolio.

It will therefore be appreciated that the present invention provides a much simpler and more economical method of manufacturing a portfolio. Specifically, the present invention does not require any stitching for securing the members together, but rather, provides a heat seal in place thereof. Further, the heat seal can be provided with a decorative pattern, so as to simulate stitching. In addition, there is little waste of material, since inner flap 50, card holder 52 and penholder 60 are formed using the inner area of the vinyl decorative material 34 that was cut away by the knife rule.

Having described a specific preferred embodiment of the invention with reference to the accompanying drawings, it will be appreciated that the present invention is not limited to this precise embodiment and that various changes and modifications can be effected therein by one of ordinary skill in the art without departing from the scope or spirit of the invention defined by the appended claims. For example, while the foregoing description has been made with reference to a portfolio, it is foreseen that this invention is applicable to manufacturing ring binders, business card holders, compact disc cases/holders, photo albums, book covers and the like, and that the use of the word portfolio is meant to include such items.

What is claimed is:

1. A portfolio comprising:

a cover sheet having an outer peripheral edge, an outer surface and an inner surface;

a backing sheet having an outer peripheral edge, an outer surface and an inner surface;

a stiffening member interposed between the inner surface of said cover sheet and the inner surface of said backing sheet; and an edge member having an outer peripheral edge, an inner peripheral edge, an outer surface and an inner surface, the inner peripheral edge of said edge member overlapping the outer peripheral edge of said cover sheet, the inner surface of said edge member and the outer surface of said cover sheet being heat sealed together, and the outer peripheral edge of said edge member and the outer peripheral edge of the backing sheet being heat sealed together to retain the stiffening member between the cover sheet and the backing sheet.

2. The portfolio according to claim 1, wherein at least one of said cover sheet and said edge member is a vinyl material.

3. The portfolio according to claim 2, wherein the other of said cover sheet and said edge member is a fabric such as nylon, cotton or polyester laminated to a PVC film.

4. The portfolio according to claim 1, wherein said heat seal of said edge member to said cover sheet is an applique heat seal that imparts a predetermined design to one of said cover sheet and said edge member.

5. The portfolio according to claim 4, wherein said predetermined design is a simulated stitch design.

6. The portfolio according to claim 1, wherein said stiffening member is cardboard.

7. The portfolio according to claim 1, further comprising non-simulated stitching proximate to an outer periphery of said portfolio.

8. The portfolio according to claim 7, wherein said non-simulated stitching extends through at least two of said edge member, said cover sheet, said stiffening member and said backing sheet.

9. The portfolio according to claim 1, further comprising a flap secured to the outer surface of said second sheet of material for forming a storage pocket.

10. The portfolio according to claim 1, further comprising a patch heat sealed to an outer surface of said cover sheet.

11. The portfolio according to claim 10, wherein a region of said cover sheet superposed with respect to said patch is removed from said cover sheet so that a texture of said cover sheet beneath the patch does not adversely affect clarity of an identifying printing which may be applied to said patch.

12. The portfolio according to claim 1, wherein said stiffening member comprises:

a first rigidifying member superposed with the inner surface of said cover sheet corresponding to a top panel of said portfolio; and a second rigidifying member superposed with the inner surface of said cover sheet adjacent to said first rigidifying member, corresponding to a bottom panel of said portfolio, with a spacing between said first and second rigidifying members which defines a narrow binding edge which connects together side edges of said top and bottom panels.

13. A method of forming a portfolio, comprising the steps of:

providing a cover sheet including an outer peripheral edge having a perimeter, an outer surface and an inner surface;

overlying an edge member including an outer peripheral edge having a perimeter greater than the perimeter of the outer peripheral edge of said cover sheet;

heat sealing the edge member to said cover sheet proximate the outer peripheral edge of said cover sheet;

positioning a first stiffening member to an inner surface of said cover sheet corresponding to a top panel of said portfolio, and a second stiffening member to an inner surface of said cover sheet adjacent to said first stiffening member, corresponding to a bottom panel of said portfolio, with a spacing between said first and second stiffening members which defines a narrow binding edge which connects together side edges of said top and bottom panels;

positioning a backing sheet over said first and second stiffening members; and heat sealing said backing sheet to said edge member so as to retain said stiffening members between said backing sheet and said cover sheet.

14. The method according to claim 13, wherein said heat sealing of said edge member to said cover sheet comprises an applique heat sealing process that imparts a predetermined design to said edge member.

15. The method according to claim 14, wherein said predetermined design is a simulated stitching.

16. The method according to claim 13, further comprising:

applying a decorative non-simulated stitching to an outer periphery of said portfolio.

17. The method according to claim 16, wherein said decorative non-simulated stitching extends through at least two of said cover sheet, said stiffening member, said backing sheet and said edge member.

18. The method according to claim 13, further comprising:

securing an inner flap to at least one of an inner surface backing of said backing sheet and said edge member.

19. The method according to claim 13, further comprising:

removing a portion of said edge member overlying said cover sheet and within an area bounded by said heat seal.

20. The method according to claim 18, further comprising:

forming an inner flap from the removed portion of the edge member; and securing the inner flap to at least one of an inner surface of said backing sheet and said edge member.

21. The method according to claim 13, further comprising:

securing a patch to an outer surface of said cover sheet.

22. The method according to claim 21, further comprising:

heat sealing the patch at an outer periphery thereof to the cover sheet.

23. The method according to claim 21, further comprising:

removing at least a portion of said cover sheet from an area beneath said patch so that a texture of the first material beneath the patch does not affect clarity of an identifying printing which may be applied to said patch.

24. The method according to claim 21, further comprising:

applying an identifying printing on the patch.

* * * * *